US009966693B2

(12) United States Patent
Liu

(10) Patent No.: US 9,966,693 B2
(45) Date of Patent: May 8, 2018

(54) ELECTRICAL CONNECTOR ASSEMBLY

(71) Applicant: LOTES CO., LTD, Keelung (TW)

(72) Inventor: Jun Liu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days. days.

(21) Appl. No.: 15/649,787

(22) Filed: Jul. 14, 2017

(65) Prior Publication Data

US 2018/0034196 A1 Feb. 1, 2018

(51) Int. Cl.

| | |
|---|---|
| ***H01R 13/52*** | (2006.01) |
| ***H01R 13/40*** | (2006.01) |
| ***H01R 13/516*** | (2006.01) |
| ***H01R 13/6581*** | (2011.01) |
| ***H01R 13/22*** | (2006.01) |

(52) U.S. Cl.

CPC ..... *H01R 13/5219* (2013.01); *H01R 13/22* (2013.01); *H01R 13/40* (2013.01); *H01R 13/516* (2013.01); *H01R 13/5213* (2013.01); *H01R 13/6581* (2013.01)

(58) Field of Classification Search

CPC .... H01R 13/5219; H01R 13/22; H01R 13/40; H01R 13/516; H01R 13/5213; H01R 13/6581

USPC ..... 439/521

See application file for complete search history.

(56) References Cited

U.S. PATENT DOCUMENTS

| | | | | |
|---|---|---|---|---|
| 3,450,299 | A * | 6/1969 | La Barbera | B65D 83/40 220/799 |
| 4,170,316 | A * | 10/1979 | LaBarbera | B29C 45/4421 220/799 |
| 6,854,616 | B2 * | 2/2005 | Steffan | B65D 59/06 215/254 |
| 7,074,077 | B2 * | 7/2006 | Sakaguchi | H01R 4/70 174/76 |
| 7,140,891 | B1 * | 11/2006 | Huang | H01R 13/5213 439/137 |
| 7,534,132 | B2 * | 5/2009 | Kuo | H01R 13/5045 220/796 |

(Continued)

FOREIGN PATENT DOCUMENTS

| | | |
|---|---|---|
| CN | 2664228 Y | 12/2004 |
| CN | 2692870 Y | 4/2005 |

(Continued)

*Primary Examiner* — Abdullah Riyami
*Assistant Examiner* — Vladimir Imas
(74) *Attorney, Agent, or Firm* — Locke Lord LLP; Tim Tingkang Xia, Esq.

(57) ABSTRACT

An electrical connector assembly, including: an insulating body, concavely provided backward with an insertion cavity at its front end; multiple terminals, each having an elastic contact portion extending into the insertion cavity; a metal shell wrapping the insulating body; a shielding sheet, provided with an elastic piece protruding and extending into the insertion cavity; and a dustproof base, having a tongue and two guide walls located on two sides of the tongue. The guide walls fit with outer wall surfaces of the metal shell to fix and guide the tongue to be horizontally inserted into the insertion cavity. At least one of the elastic piece and the elastic contact portion elastically abuts the tongue to further fix the dustproof base, thus easily fixing the dustproof base.

13 Claims, 8 Drawing Sheets

(56) References Cited

U.S. PATENT DOCUMENTS

| | | | | |
|---|---|---|---|---|
| 7,645,170 | B2 * | 1/2010 | Long | H01R 13/5202 439/668 |
| 7,654,835 | B1 * | 2/2010 | Chiang | H01R 13/5213 439/137 |
| 7,758,379 | B2 * | 7/2010 | Chen | H01R 13/6485 439/607.11 |
| 7,789,679 | B2 * | 9/2010 | Wu | H01R 13/5213 439/135 |
| 8,556,648 | B2 * | 10/2013 | Wu | H01R 13/5213 439/276 |
| 8,696,220 | B2 * | 4/2014 | Wu | G02B 6/3849 385/147 |
| 8,772,637 | B2 * | 7/2014 | Wu | H02G 15/115 174/84 R |
| 9,231,356 | B1 * | 1/2016 | Ju | H01R 24/78 |
| 9,281,626 | B2 * | 3/2016 | Lin | H01R 13/6581 |
| 9,379,494 | B1 * | 6/2016 | Hu | H01R 13/6594 |
| 9,502,821 | B2 * | 11/2016 | Little | H01R 13/6582 |
| 9,502,837 | B2 * | 11/2016 | Kao | H01R 24/60 |
| 9,620,899 | B2 * | 4/2017 | Kato | H01R 13/631 |
| 9,728,885 | B2 * | 8/2017 | Yokoyama | H01R 13/502 |
| 9,768,568 | B1 * | 9/2017 | Jin | H01R 24/60 |
| 9,780,500 | B2 * | 10/2017 | Kao | H01R 13/6658 |
| 2011/0188818 | A1 * | 8/2011 | Sun | G02B 6/36 385/94 |
| 2015/0340791 | A1 * | 11/2015 | Kao | H01R 24/60 439/676 |

FOREIGN PATENT DOCUMENTS

| | | | |
|---|---|---|---|
| CN | 2742639 | Y | 11/2005 |
| CN | 2886842 | Y | 4/2007 |
| CN | 201029152 | Y | 2/2008 |
| CN | 201112893 | Y | 9/2008 |
| CN | 101826678 | A | 9/2010 |
| CN | 201656123 | U | 11/2010 |
| CN | 202363647 | U | 8/2012 |
| CN | 203260821 | U | 10/2013 |
| CN | 203747158 | U | 7/2014 |
| TW | M337181 | U | 7/2008 |
| TW | 201547113 | A | 12/2015 |
| TW | 201547124 | A | 12/2015 |
| TW | 201607158 | A | 2/2016 |
| TW | 201607166 | A | 2/2016 |
| TW | 201607182 | A | 2/2016 |

* cited by examiner

B–B

C–C

ELECTRICAL CONNECTOR ASSEMBLY

CROSS-REFERENCE TO RELATED APPLICATIONS

This non-provisional application claims priority to and the benefit of, pursuant to 35 U.S.C. § 119(a), Patent Application Serial No. 201620787564.9 filed in P.R. China on Jul. 26, 2016, the entire content of which is hereby incorporated by reference.

FIELD OF THE INVENTION

The present invention relates to an electrical connector assembly, and more particularly to an electrical connector assembly having a dustproof base.

BACKGROUND OF THE INVENTION

As market demands for the electronic industry continuously change and when people use various electronic devices, the quality of each electronic product is more strictly required, in order to prevent an electrical connector from being oxidized due to dust or moisture during informal use or in a transportation process, generally a technician will arrange a dustproof cover to cover a docking port of the electrical connector. An existing plug connector comprises an insulating body and multiple conductive terminals accommodated in the insulating body, a docking port concavely provided at a front end of the insulating body, a shielding shell sleeved on the insulating body, and a dustproof cover sleeved over the shielding shell to seal the docking port so as to achieve dustproof and anti-oxidation effects. The dustproof cover is provided with four side walls at the periphery, and is assembled to the electrical connector only by means of a tight fit between the four side walls and the shielding shell of the electrical connector, without using other structures to fix the dustproof cover.

However, in actual production and manufacturing of the dustproof cover, a fit tolerance between the dustproof cover and the shielding shell of the electrical connector is not easily controlled, so as to result in an over-tight or over-loose fit between the dustproof cover and the shielding shell. If the fit between the dustproof cover and the shielding shell is over-tight, the dustproof cover is not easily detached from the electrical connector, which may even cause the shielding shell to deform due to over-extrusion. If the fit between the dustproof cover and the shielding shell is over-loose, the dustproof cover is easily loosened from the electrical connector, such that fixing of the dustproof cover is difficult. Moreover, the dustproof cover only has the side walls wrapping the shielding shell to prevent external dust from entering it, which does not prevent the conductive terminals from contacting dust and moisture inside the docking port. Thus, good dustproof and anti-oxidation effects cannot be achieved.

Therefore, a heretofore unaddressed need to design an improved electrical connector exists in the art to address the aforementioned deficiencies and inadequacies.

SUMMARY OF THE INVENTION

In view of the above problems in the background, one aspect of the present invention is directed to an electrical connector assembly having a dustproof base that is easy to fix and has good dustproof and anti-oxidation effects.

To achieve the foregoing objective, one aspect of the invention provides an electrical connector assembly, which includes: an insulating body, wherein an insertion cavity is concavely provided backward at a front end of the insulating body; a plurality of terminals, accommodated in the insulating body, wherein each of the terminals has an elastic contact portion extending into the insertion cavity; a metal shell, wrapping the insulating body; at least one shielding sheet, arranged between the metal shell and the insulating body, the shielding sheet is provided with at least one elastic piece protruding and extending into the insertion cavity; and a dustproof base having a tongue and two guide walls located on two sides of the tongue, the tongue is inserted into the insertion cavity, a rear end of each of the guide walls being located farther to the front end of the insulating body than a rear end of the tongue, wherein the guide walls fit with outer wall surfaces of the metal shell, and at least one of the elastic piece and the elastic contact portion elastically abuts the tongue.

In certain embodiments, the outer wall surfaces at two opposite sides of the metal shell are arc-shaped surfaces, and inner wall surfaces of the two guide walls are arc-shaped surfaces correspondingly fitting with and fixed to the outer wall surfaces at the two opposite sides of the metal shell, respectively.

In one embodiment, the dustproof base has a substrate located outside the insertion cavity, the tongue is formed by extending horizontally backward from the substrate, the two guide walls are formed by extending backward from two sides of the substrate, the tongue has a first step and a second step in a backward sequence from the substrate, and the elastic piece abuts the first step. In certain embodiments, the elastic contact portion elastically abuts the second step.

In certain embodiments, the first step is provided with, along a vertical direction, a plurality of barriers at intervals and at least one groove, wherein each groove is located between each two adjacent barriers, and the elastic piece is located in the groove.

In one embodiment, a stopping block is provided by vertically protruding from a rear end of a bottom surface of the groove, and the stopping block is configured to block the elastic piece from exiting the groove backward.

In certain embodiments, the insulating body is provided with a plurality of openings along a vertical direction perpendicular to a longitudinal direction, the openings are connected with the insertion cavity; and the shielding sheet is provided with a plurality of the elastic pieces to correspondingly penetrate throughout the openings, and each elastic piece is correspondingly located in the groove.

In certain embodiments, the electrical connector assembly further includes at least one connecting wall, wherein each connecting wall is provided between each two adjacent openings, and each connecting wall is correspondingly in an interference fit with each of the barriers.

In certain embodiments, the insulating body is provided with a plurality of terminal slots in the vertical direction perpendicular to the longitudinal direction and located at the rear sides of the openings; the terminal slots are connected with the insertion cavity and are configured to accommodate the terminals; a separation wall is provided between the terminal slots and the openings; and the tongue is provided with a third step between the first step and the second step and corresponding to the separation wall, and the third step is configured to support the separation wall.

In certain embodiments, a thickness of the second step in the vertical direction is smaller than a thickness of the third step in the vertical direction.

In certain embodiments, the terminals are arranged on the insulating body in an upper row and a lower row; the terminals in the upper row and the terminals in the lower row are respectively provided in a central symmetry about a center of the insertion cavity; and each of the terminals in the upper row has the elastic contact portion extending into the insertion cavity to elastically abut an upper surface of the tongue, and each of the terminals in the lower row has the elastic contact portion extending into the insertion cavity to elastically abut a lower surface of the tongue, respectively.

In certain embodiments, the electrical connector assembly includes two shielding sheets, wherein the two shielding sheets are installed on a top surface and a bottom surface of the insulating body respectively, the shielding sheet located on the top surface of the insulating body bends downward to form the elastic piece abutting an upper surface of the tongue, and the shielding sheet located on the bottom surface of the insulating body bends upward to form the elastic piece abutting a lower surface of the tongue.

Compared with the art, the electrical connector according to certain embodiments of the present invention has the following beneficial effects: the dustproof base is configured to block external moisture and dust from entering the insertion cavity. The dustproof base has the tongue and the guide walls located on the two sides of the tongue. The guide walls fit with outer wall surfaces of the metal shell to fix the dustproof base, and at least one of the elastic piece and the elastic contact portion elastically abuts the tongue to further fix the dustproof base, thus easily fixing the dustproof base. Moreover, the arrangement of the guide walls allows the dustproof base to be easily detached from the metal shell, and a rear end of each of the guide walls is located farther to the front end of the insulating body than a rear end of the tongue to guide the tongue to be horizontally inserted into the insertion cavity, thus preventing the terminals from being damaged due to inclined insertion of the tongue into the insertion cavity. Internal air of the insertion cavity can be pushed out by inserting the tongue into the insertion cavity, thus blocking the terminals from contacting the internal air, so the electrical connector assembly has good dustproof and anti-oxidation effects both externally and internally.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
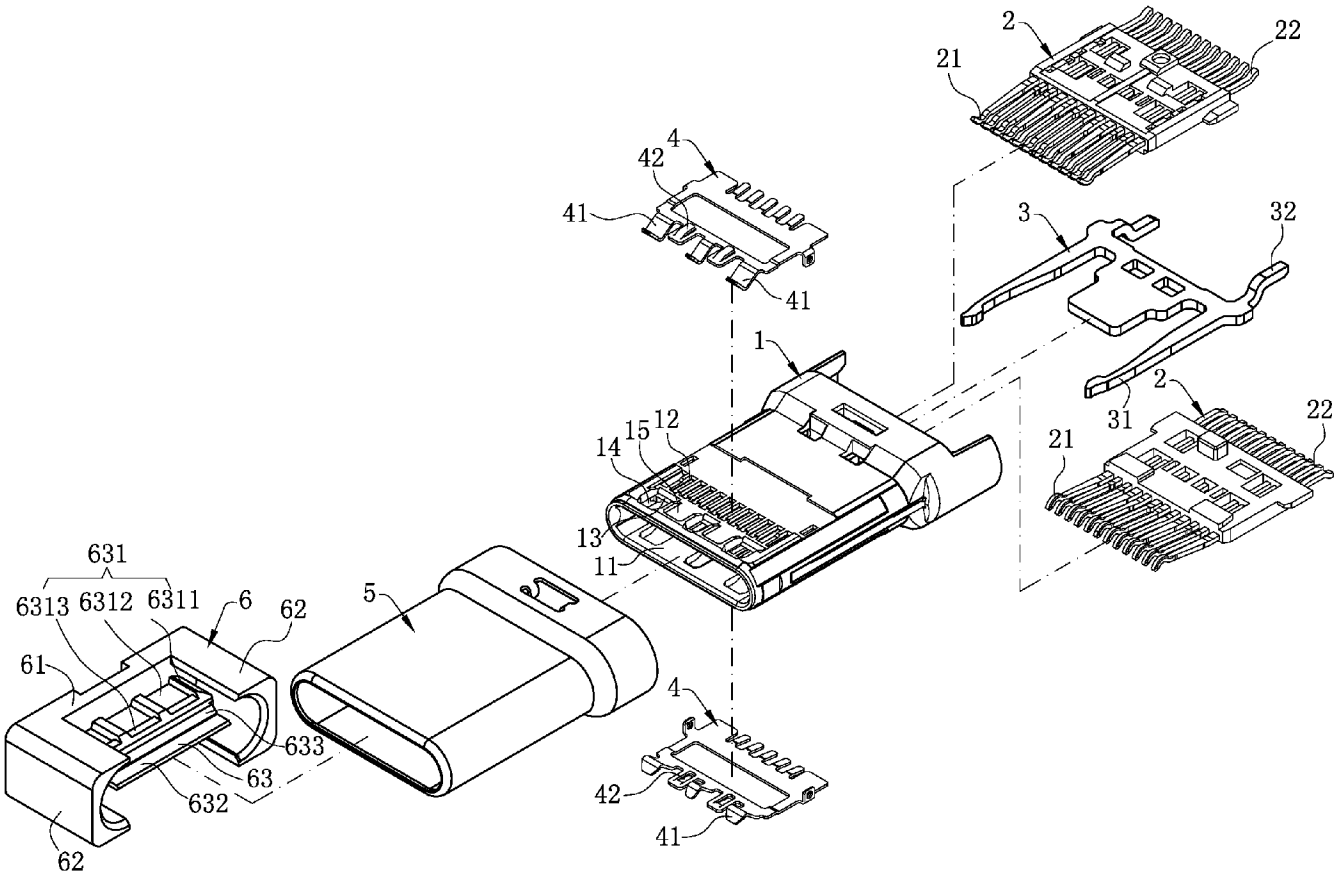
FIG. 1 is a three-dimensional exploded view of an electrical connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector assembly.

Figure 4:
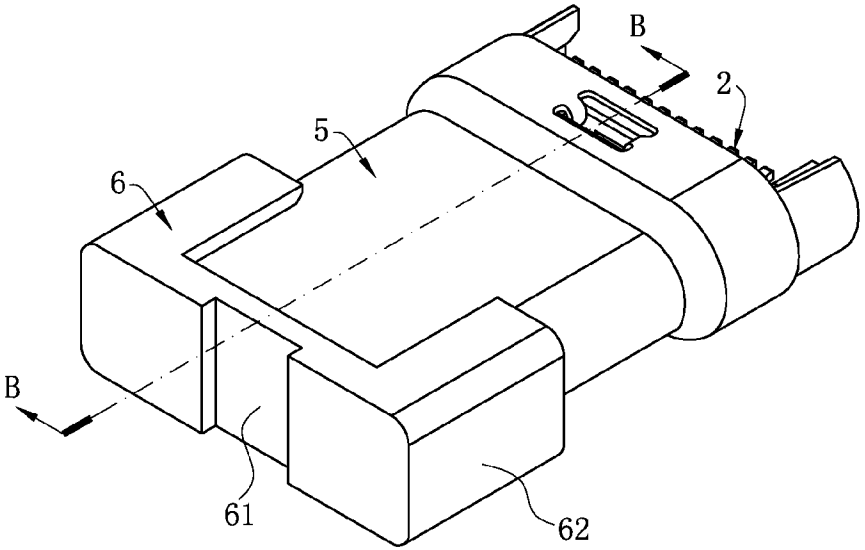
FIG. 4 is an assembled view of an electrical connector assembly according to one embodiment of the present invention.

As shown in FIG. 1 and FIG. 4, an electrical connector assembly of the present invention comprises an electrical connector (not labeled) and a dustproof base 6. The electrical connector is configured to dock with a docking connector (not shown). The electrical connector includes an insulating body 1, and an insertion cavity 11 is concavely provided backward at a front end of the insulating body 1; a plurality of terminals 2 accommodated in the insulating body 1, each terminal 2 having an elastic contact portion 21 extending into the insertion cavity 11; a metal shell 5 wrapping the insulating body 1; and at least one shielding sheet 4 arranged between the metal shell 5 and the insulating body 1, the shielding sheet 4 is provided with at least one elastic piece 41 protruding and extending into the insertion cavity 11. The dustproof base 6 is inserted into the insertion cavity 11 for dustproof of the insertion cavity 11.

Figure 2:
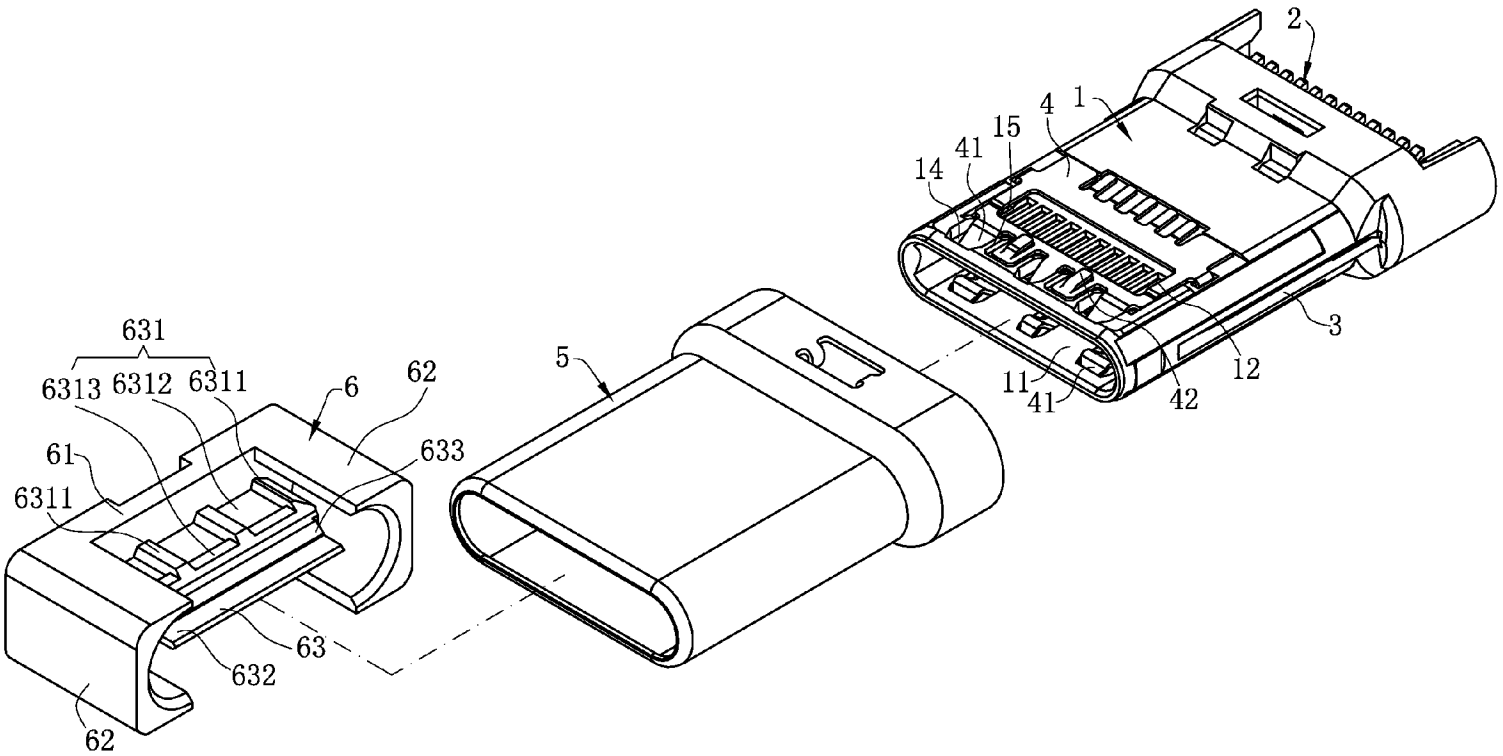
FIG. 2 is a local assembled view of an electrical connector assembly according to one embodiment of the present invention.
Figure 5:
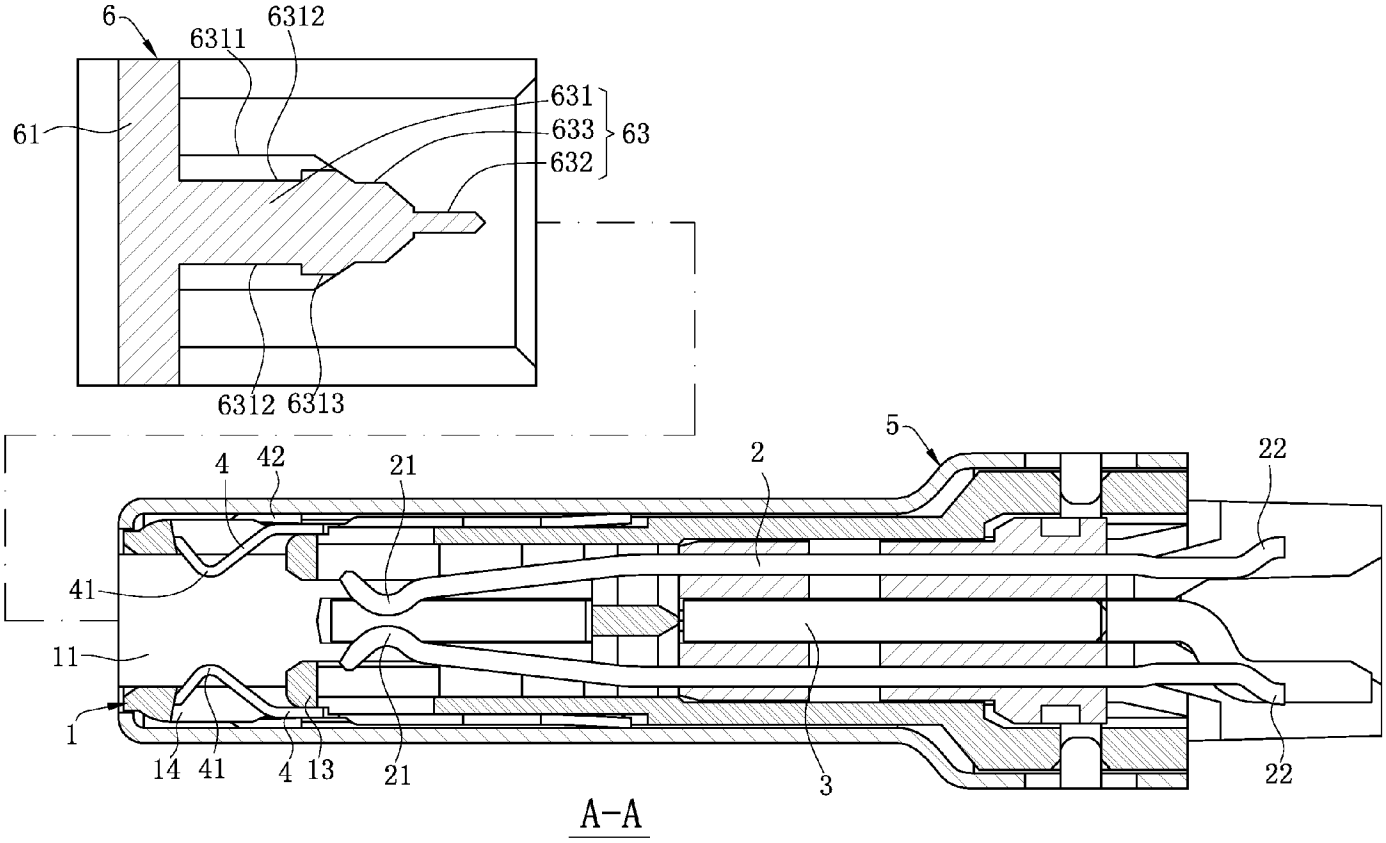
FIG. 5 is a sectional view of FIG. 3 along a line A-A according to one embodiment of the present invention.

As shown in FIG. 1, FIG. 2 and FIG. 5, the insulating body 1 is a frame-shaped structure, and the insertion cavity 11 is concavely formed in the insulating body 1 in a longitudinal direction. The insertion cavity 11 is concavely formed backward from a front end surface of the insulating body 1, and is used for the insertion of the docking connector. Multiple terminal slots 12 are provided on a top surface and a bottom surface of the insulating body 1 in a vertical direction perpendicular to a longitudinal direction to receive the terminals 2, and the multiple terminal slots 12 are all connected with the insertion cavity 11. The insulating body 1 is provided with multiple openings 14 that are located at the front side of the terminal slots 12 in a vertical direction and correspond to the shielding sheets 4. The openings 14 are connected with the insertion cavity 11. Further, at least one connecting wall 15 may be provided, and each connecting wall 15 is provided between each two adjacent openings 14, so as to separate the two adjacent openings 14. In the present embodiment, the openings 14 are provided on both the top surface and the bottom surface of the insulating body 1, and there are three openings 14. The connecting wall 15 is provided on both the top surface and the bottom surface of the insulating body 1, and there are two connecting walls 15. In other embodiments, the connecting walls 15 may be provided only on the top surface or on the bottom surface of the insulating body 1, and the number of the connecting wall 15 may be one, located to the two adjacent openings 14. The terminal slots 12 are arranged in a row in a horizontal direction perpendicular to the longitudinal direction, and the openings 14 are also arranged in a row in the horizontal direction. The terminal slots 12 are located at the rear sides of the openings 14. A separation wall 13 is provided between the terminal slots 12 and the openings 14, configured for separation of the terminal slots 12 from the openings 14.

As shown in FIG. 1, FIG. 2 and FIG. 5, when the docking connector is inserted into the insertion cavity 11, the terminals 2 are correspondingly accommodated in the terminal slots 12. The terminals 2 are arranged on the insulating body 1 in an upper row and a lower row, and the terminals 2 in the upper row and the terminals 2 in the lower row are respectively provided in a central symmetry about a center of the insertion cavity 11, such that the docking connector may be inserted in dual directions. The front end of each terminal 2 bends to form an elastic contact portion 21 that extends into the insertion cavity 11, and the rear end of each terminal 2 has a soldering portion 22 for being soldered to a circuit board (not shown). A grounding piece 3 is inserted between the terminals 2 in the upper row and the lower row, and is used for shielding an interference signal between the terminals 2 in the upper row and the terminals 2 in the lower row. A pair of latch arms 31 extend forwards from the grounding piece 3 for fitting with the docking connector. A pair of soldering arms 32 extend backward from the grounding piece 3 for being soldered to the circuit board.

As shown in FIG. 1, FIG. 2 and FIG. 5, the shielding sheet 4 is installed on the insulating body 1 and is located between the metal shell 5 and the insulating body 1. At least one elastic piece 41 protrudes from the shielding sheet 4 and extends into the insertion cavity 11. In the present embodiment, there are two shielding sheets 4 respectively installed on the top surface and the bottom surface of the insulating body 1, for shielding a signal interference between the upper side and the lower side of the terminals 2 in the upper row and in the lower row. In other embodiments, there may be one shielding sheet 4. In the present embodiment, each shielding sheet 4 has three elastic pieces 41, all extending forward from the front side of each shielding sheet 4 for fixing and fitting with the dustproof base 6. In other embodiments, there may be one or more elastic pieces 41 on each shielding sheet 4, provided that the quantity of the elastic pieces 41 is the same as the quantity of the openings 14. The shielding sheet 4 located on the top surface of the insulating body 1 bends downward to form the elastic piece 41, and the shielding sheet 4 located on the bottom surface of the insulating body 1 bends upward to form the elastic piece 41. The elastic pieces 41 on the two sides are arranged in an opposite way so as to clamp and fix the dustproof base 6. Each shielding sheet 4 is provided with at least one contact arm 42. Each contact arm 42 is located between the two adjacent elastic pieces 41 and covers the connecting wall 15 for contacting the metal shell 5 to ground the shielding sheets 4 through the metal shell 5.

Figure 3:
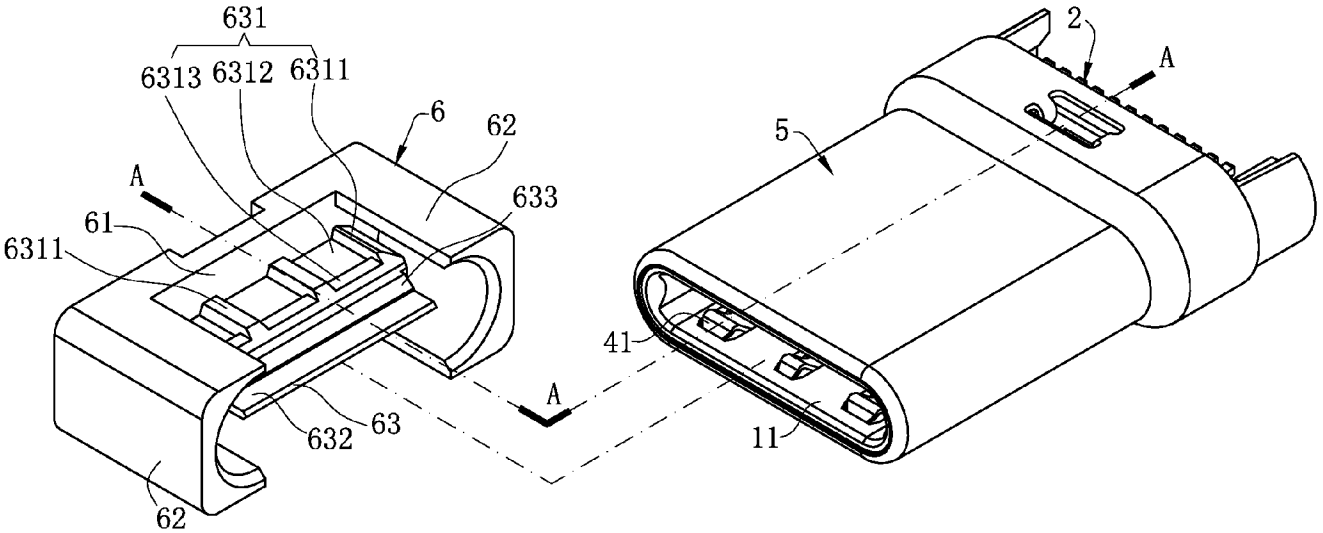
FIG. 3 is a three-dimensional view of an electrical connector separated from a dustproof base according to one embodiment of the present invention.

As shown in FIG. 1, FIG. 3 and FIG. 4, the metal shell 5 is formed in a drawing process, such that both outer wall surfaces of two opposite sides of the metal shell 5 are arc-shaped surfaces, so as to make it convenient to insert and pull out the dustproof base 6. Moreover, the surface of the metal shell 5 is seamless, which effectively prevents external foreign objects from entering the metal shell 5. The metal shell 5 completely wraps the insulating body 1 so as to provide good shielding for the electrical connector.

Figure 6:
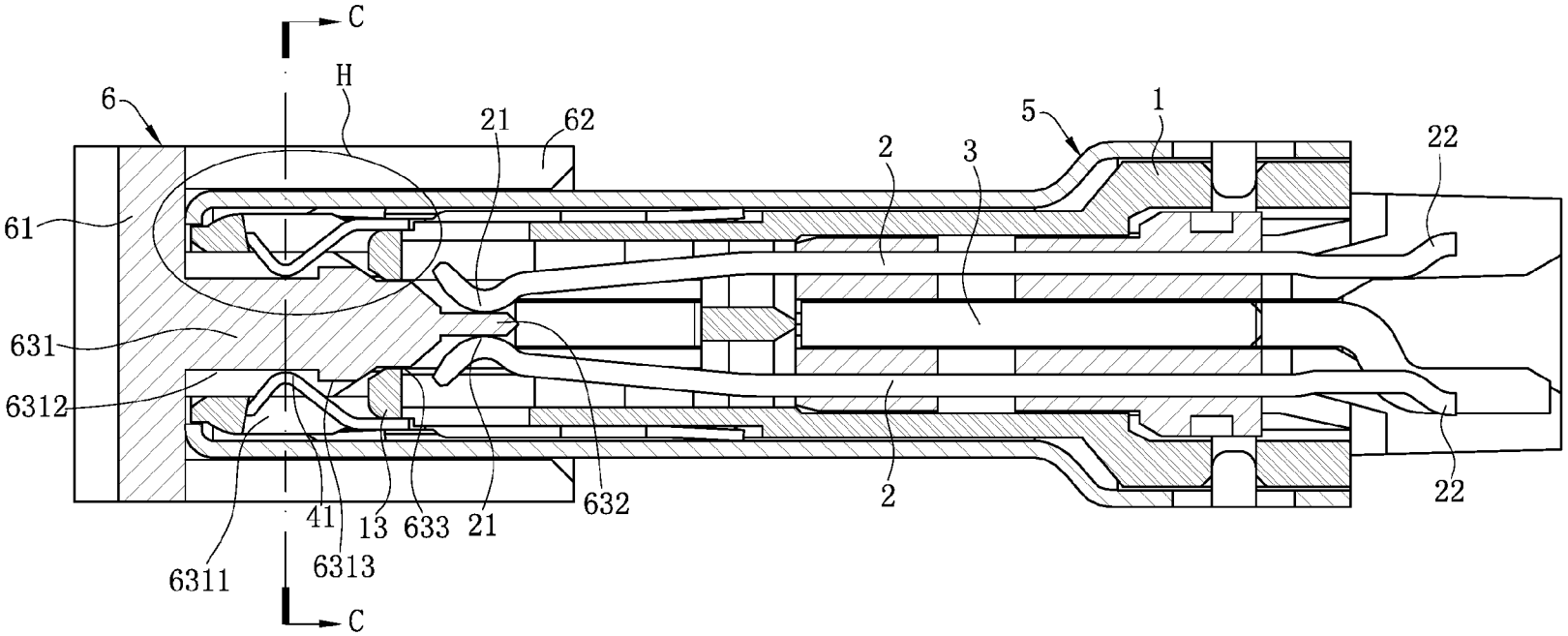
FIG. 6 is a sectional view of FIG. 4 along a line B-B according to one embodiment of the present invention.
Figure 7:
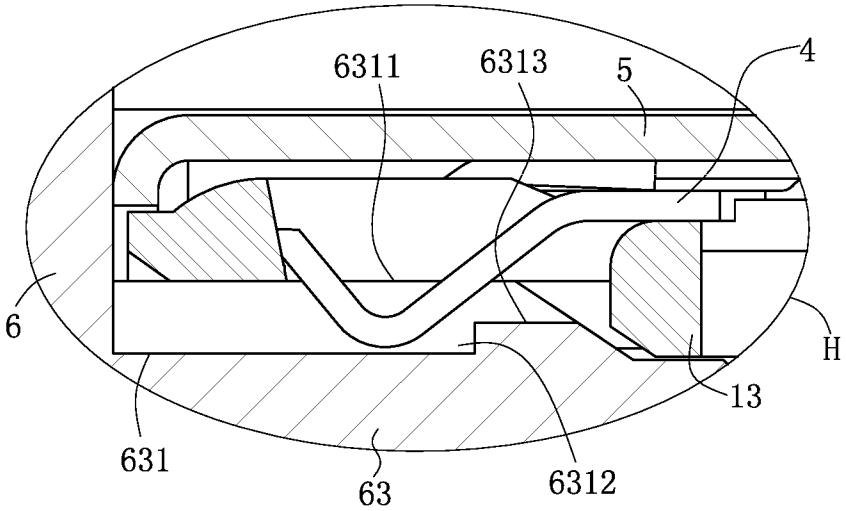
FIG. 7 is an enlarged view of part H in FIG. 6.
Figure 8:
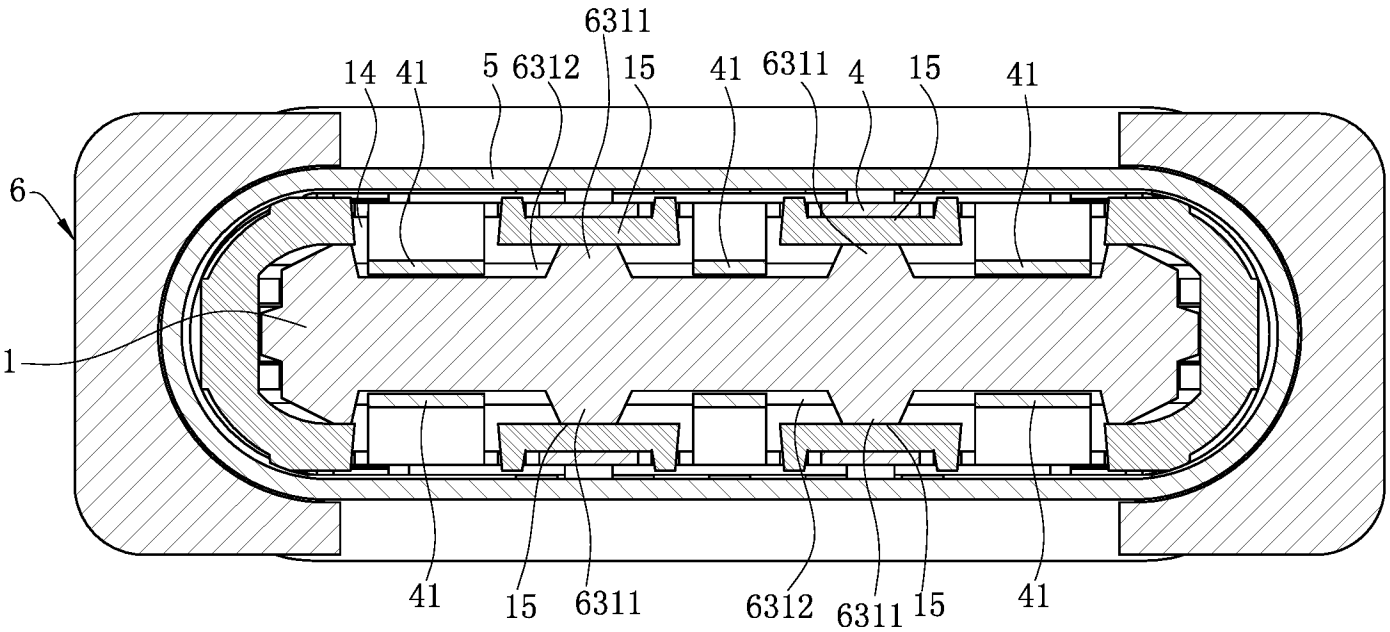
FIG. 8 is a sectional view of FIG. 6 along a line C-C according to one embodiment of the present invention.

As shown in FIG. 1, FIG. 5 and FIG. 6, the dustproof base 6 is made of a plastic material. The front end of the dustproof base 6 is provided with a substrate 61 located outside the insertion cavity 11. The substrate 61 is used for sealing an opening end of the insertion cavity 11 so as to prevent external dust and moisture from entering the insertion cavity 11. The dustproof base 6 has a tongue 63 and two guide walls 62 located on two sides of the tongue 63, the tongue 63 is formed by extending horizontally backward from the substrate 61, the two guide walls 62 are formed by extending backward from two sides of the substrate 61, and a rear end of each of the two guide walls 62 is located at a rear position in comparison to that of the tongue 63. The guide walls 62 fit with the outer wall surfaces of the metal shell 5 to fix the dustproof base 6, and the elastic piece 41 and the elastic contact portion 21 elastically abuts the tongue 63 to further fix the dustproof base 6, thus easily fixing the dustproof base 6. Moreover, the arrangement of the guide walls 62 allows the dustproof base 6 to be easily detached from the metal shell 5, and the rear end of each of the guide walls 62 is located farther to the front end of the insulating body 1 than the rear end of the tongue 63 to guide the tongue 63 to be horizontally inserted into the insertion cavity 11, thus preventing the terminals 2 from being damaged due to inclined insertion of the tongue 63 into the insertion cavity 11. Internal air of the insertion cavity 11 can be pushed out by inserting the tongue 63 into the insertion cavity 11, thus blocking the terminals 2 from contacting the internal air, so the electrical connector assembly has good dustproof and anti-oxidation effects both externally and internally. In the present embodiment, both the elastic piece 41 and the elastic contact portion 21 abut the tongue 63. In other embodiments, it is possible that only the elastic piece 41 abuts the tongue 63, or only the elastic contact portion 21 abuts the tongue 63. In the present embodiment, the terminals 2 in the upper row and in the lower row both have the elastic contact portions 21 extending into the insertion cavity 11 to elastically abut the upper and lower surfaces of the tongue 63, respectively. In other words, the elastic contact portions 21 in the upper row and in the lower row elastically clamp the tongue 63. The shielding sheet 4 located at the top of the insulating body 1 bends down to form the elastic piece 41 contacting the upper surface of the tongue 63, and the shielding sheet 4 located at the bottom of the insulating body 1 bends up to form the elastic piece 41 contacting the lower surface of the tongue 63. That is, the elastic pieces 41 of the two shielding sheets 4 elastically clamp the upper and lower surfaces of the tongue 63 to further enhance the retaining force of the tongue 63.

As shown in FIG. 5 to FIG. 8, the dustproof base 6 covers the outer wall surfaces of two sides of the metal shell 5 from front to back. The two guide walls 62 are formed by extending backward from two sides of the substrate 61, respectively, and the two guide walls 62 are separated from each other, such that the dustproof base 6 is easily installed. Inner wall surfaces of both the two guide walls 62 are arc-shaped surfaces, and the outer wall surfaces of two opposite sides of the metal shell 5 are arc-shaped surfaces. The inner wall surfaces of the two guide walls 62 correspondingly fit with and are fixed to the outer wall surfaces of the two opposite sides of the metal shell 5, respectively, so as to guide and limit the tongue 63 in the vertical direction and the horizontal direction, thus preventing the tongue 63 from collision against the terminals 2 and the interiors of the insertion cavity 11 due to inclined insertion, and ensuring the tongue 63 to be smoothly inserted in and pulled out of the insertion cavity 11 without damaging the terminals 2. The tongue 63 extends horizontally backward from the substrate 61, and is provided with a first step 631 and a second step 632 in a sequence. The elastic piece 41 abuts the first step 631, and the elastic contact portion 21 abuts the second step 632, thereby separating the elastic contact portion 21 from the elastic piece 41, and avoiding short circuit due to contact between the elastic contact portion 21 and the elastic piece 41. The first step 631 is provided with, in the vertical direction, multiple barriers 6311 at intervals, and a groove 6312 is located between each two adjacent barriers 6311. Since multiple barriers 6311 are provided, there may be multiple grooves 6312 provided. The elastic pieces 41 are correspondingly located in the grooves 6312 and abut the bottom surfaces of the grooves 6312. A stopping block 6313 vertically protrudes from the rear end of the bottom surface of the groove 6312, for blocking the elastic piece 41 from exiting the groove 6312 backward, and the barrier 6311 blocks the elastic piece 41 from exiting from two sides thereof, so as to prevent the elastic piece 41 from crossing the groove 6312 to be separated from the tongue 63. The barriers 6311 are protrudingly provided in the vertical direction. Each connecting wall 15 is correspondingly in an interference fit with each barrier 6311. Thus, the retaining force of the tongue 63 is enhanced, and the barriers 6311 may secure the positions of the connecting walls 15, thus avoiding influences on functions of the electrical connector due to thermal deformation of the connecting walls 15 under a high-temperature environment. The tongue 63 is further provided with a third step 633 between the first step 631 and the second step 632, and a thickness of the second step 632 in the vertical direction is smaller than that of the third step 633 in the vertical direction. The third step 633 corresponds to the separation wall 13. That is, the third step 633 and the separation wall 13 overlap in the vertical direction. The third step 633 is used to support the separation wall 13 so as to avoid deformation or even fracture of the separation wall 13 due to an external force or a high temperature.

As shown in FIG. 5 to FIG. 8, during assembly, the terminals 2 in the upper row and the terminals 2 in the bottom row both are installed in the insulating body 1, and the elastic contact portion 21 extends into the insertion cavity 11, and the soldering portion 22 is exposed outside the insulating body 1. Then the two shielding sheets 4 are installed on the top surface and the bottom surface of the insulating body 1 respectively, so the elastic pieces 41 penetrate throughout the openings 14 and enter the insertion cavity 11 respectively, and the grounding piece 3 is inserted into the insulating body 1 and is located between the two rows of terminals 2. Then the metal shell 5 is sleeved over the insulating body 1 from front to rear. Finally, the dustproof base 6 covers the front section of the metal shell 5 from front to rear, so the substrate 61 blocks the opening of the insertion cavity 11, and the tongue 63 is horizontally inserted into the insertion cavity 11 under the guidance of the guide walls 62. Moreover, the elastic pieces 41 elastically abut the first step 631, each barrier 6311 is in an interference fit with each connecting wall 15, the elastic contact portion 21 elastically abuts the second step 632, and the third step 633 correspondingly supports the separation wall 13, thereby completing the electrical connector assembly.

To sum up, in certain embodiments, the electrical connector assembly of the present invention has the following beneficial effects:

(1) The substrate 61 is used for sealing an opening end of the insertion cavity 11 so as to prevent external dust and moisture from entering the insertion cavity 11. The guide walls 62 fit with the outer wall surfaces of the metal shell 5 to fix the dustproof base 6, and the elastic piece 41 and the elastic contact portion 21 elastically abuts the tongue 63 to further fix the dustproof base 6, thus easily fixing the dustproof base 6. Moreover, the arrangement of the guide walls 62 allows the dustproof base 6 to be easily detached from the metal shell 5, and the rear end of each of the guide walls 62 is located farther to the front end of the insulating body 1 than the rear end of the tongue 63 to guide the tongue 63 to be horizontally inserted into the insertion cavity 11, thus preventing the terminals 2 from being damaged due to inclined insertion of the tongue 63 into the insertion cavity 11. Internal air of the insertion cavity 11 can be pushed out by inserting the tongue 63 into the insertion cavity 11, thus blocking the terminals 2 from contacting the internal air, so the electrical connector assembly has good dustproof and anti-oxidation effects both externally and internally.

(2) The terminals 2 in the upper row and in the lower row both have the elastic contact portions 21 extending into the insertion cavity 11 to elastically abut the upper and lower surfaces of the tongue 63, respectively. In other words, the elastic contact portions 21 in the upper row and in the lower row elastically clamp the tongue 63. The shielding sheet 4 located at the top of the insulating body 1 bends down to form the elastic piece 41 contacting the upper surface of the tongue 63, and the shielding sheet 4 located at the bottom of the insulating body 1 bends up to form the elastic piece 41 contacting the lower surface of the tongue 63. That is, the elastic pieces 41 of the two shielding sheets 4 elastically clamp the upper and lower surfaces of the tongue 63 to further enhance the retaining force of the tongue 63.

(3) The two guide walls 62 are formed by extending backward from two sides of the substrate 61, respectively, and the two guide walls 62 are separated from each other, such that the dustproof base 6 is easily installed. Inner wall surfaces of both the two guide walls 62 are arc-shaped surfaces, and the outer wall surfaces of two opposite sides of the metal shell 5 are arc-shaped surfaces. The inner wall surfaces of the two guide walls 62 correspondingly fit with and are fixed to the outer wall surfaces of the two opposite sides of the metal shell 5, respectively, so as to guide and limit the tongue 63 in the vertical direction and the horizontal direction, thus preventing the tongue 63 from collision against the terminals 2 and the interiors of the insertion cavity 11 due to inclined insertion, and ensuring the tongue 63 to be smoothly inserted in and pulled out of the insertion cavity 11 without damaging the terminals 2.

(4) A stopping block 6313 vertically protrudes from the rear end of the bottom surface of the groove 6312, for blocking the elastic piece 41 from exiting the groove 6312 backward, and the barrier 6311 blocks the elastic piece 41 from exiting from two sides thereof, so as to prevent the elastic piece 41 from crossing the groove 6312 to be separated from the tongue 63.

(5) The barriers 6311 are protrudingly provided in the vertical direction. Each connecting wall 15 is correspondingly in an interference fit with each barrier 6311. Thus, the retaining force of the tongue 63 is enhanced, and the barriers 6311 may secure the positions of the connecting walls 15, thus avoiding influences on functions of the electrical connector due to thermal deformation of the connecting walls 15 under a high-temperature environment.

(6) A thickness of the second step 632 in the vertical direction is smaller than that of the third step 633 in the vertical direction. The third step 633 corresponds to the separation wall 13. That is, the third step 633 and the separation wall 13 overlap in the vertical direction. The third step 633 is used to support the separation wall 13 so as to avoid deformation or even fracture of the separation wall 13 due to an external force or a high temperature.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

an insulating body, wherein an insertion cavity is concavely provided backward at a front end of the insulating body;

a plurality of terminals, accommodated in the insulating body, wherein each of the terminals has an elastic contact portion extending into the insertion cavity;

a metal shell, wrapping the insulating body;

at least one shielding sheet, arranged between the metal shell and the insulating body, the shielding sheet is provided with at least one elastic piece protruding and extending into the insertion cavity; and a dustproof base, having a tongue and two guide walls located on two sides of the tongue, the tongue is inserted into the insertion cavity, a rear end of each of the guide walls being located farther to the front end of the insulating body than a rear end of the tongue, wherein the guide walls fit with outer wall surfaces of the metal shell, and at least one of the elastic piece and the elastic contact portion elastically abuts the tongue.

2. The electrical connector assembly of claim 1, wherein the outer wall surfaces at two opposite sides of the metal shell are arc-shaped surfaces, and inner wall surfaces of the two guide walls are arc-shaped surfaces correspondingly fitting with and fixed to the outer wall surfaces at the two opposite sides of the metal shell, respectively.

3. The electrical connector assembly of claim 1, wherein the dustproof base has a substrate located outside the insertion cavity, the tongue is formed by extending horizontally backward from the substrate, the two guide walls are formed by extending backward from two sides of the substrate, the tongue has a first step and a second step in a backward sequence from the substrate, and the elastic piece abuts the first step.

4. The electrical connector assembly of claim 3, wherein the elastic contact portion elastically abuts the second step.

5. The electrical connector assembly of claim 3, wherein the first step is provided with, along a vertical direction, a plurality of barriers at intervals and at least one groove, wherein each groove is located between each two adjacent barriers, and the elastic piece is located in the groove.

6. The electrical connector assembly of claim 5, wherein a stopping block is provided by vertically protruding from a rear end of a bottom surface of the groove, and the stopping block is configured to block the elastic piece from exiting the groove backward.

7. The electrical connector assembly of claim 5, wherein:

the insulating body is provided with a plurality of openings along a vertical direction perpendicular to a longitudinal direction, the openings are connected with the insertion cavity; and the shielding sheet is provided with a plurality of the elastic pieces to correspondingly penetrate throughout the openings, and each elastic piece is correspondingly located in the groove.

8. The electrical connector assembly of claim 7, further comprising at least one connecting wall, wherein each connecting wall is provided between each two adjacent openings, and each connecting wall is correspondingly in an interference fit with each of the barriers.

9. The electrical connector assembly of claim 7, wherein:

the insulating body is provided with a plurality of terminal slots in the vertical direction perpendicular to the longitudinal direction and located at the rear sides of the openings;

the terminal slots are connected with the insertion cavity and are configured to accommodate the terminals;

a separation wall is provided between the terminal slots and the openings; and the tongue is provided with a third step between the first step and the second step and corresponding to the separation wall, and the third step is configured to support the separation wall.

10. The electrical connector assembly of claim 9, wherein a thickness of the second step in the vertical direction is smaller than a thickness of the third step in the vertical direction.

11. The electrical connector assembly of claim 1, wherein:

the terminals are arranged on the insulating body in an upper row and a lower row;

the terminals in the upper row and the terminals in the lower row are respectively provided in a central symmetry about a center of the insertion cavity; and each of the terminals in the upper row has the elastic contact portion extending into the insertion cavity to elastically abut an upper surface of the tongue, and each of the terminals in the lower row has the elastic contact portion extending into the insertion cavity to elastically abut a lower surface of the tongue, respectively.

12. The electrical connector assembly of claim 1, comprising two shielding sheets, wherein the two shielding sheets are installed on a top surface and a bottom surface of the insulating body respectively, the shielding sheet located on the top surface of the insulating body bends downward to form the elastic piece abutting an upper surface of the tongue, and the shielding sheet located on the bottom surface of the insulating body bends upward to form the elastic piece abutting a lower surface of the tongue.

13. The electrical connector assembly of claim 1, wherein:

the shielding sheet is provided with a plurality of the elastic pieces protruding from the shielding sheet and extending into the insertion cavity to abut the tongue; and the shielding sheet is provided with at least one contact arm, wherein each contact arm is located between each two adjacent elastic pieces and contacts the metal shell.

* * * * *